United States Patent [19]

Bae

[11] Patent Number: 4,702,521

[45] Date of Patent: Oct. 27, 1987

[54] ASSEMBLED CHAIR OR FLOWERPOT HOLDER

[76] Inventor: Deung Bae, Sudaemun-Ku, Seoul, Rep. of Korea

[21] Appl. No.: 878,338

[22] Filed: Jun. 25, 1986

[30] Foreign Application Priority Data

Jun. 27, 1985 [KR] Rep. of Korea ..... 7781/1985

[51] Int. Cl.[4] ..... A47C 7/00

[52] U.S. Cl. ..... 297/440; 297/192; 297/217

[58] Field of Search ..... D6/370; 297/192, 188, 297/443, 442, 440, 230, 231, 217; 248/318

[56] References Cited

U.S. PATENT DOCUMENTS

| | | | |
|---|---|---|---|
| D. 260,459 | 9/1981 | Lamb | D6/370 |
| 1,755,215 | 4/1930 | Glass | 297/192 |
| 2,876,828 | 3/1958 | Mayer | 297/443 |
| 4,084,779 | 4/1978 | Moineau | 248/318 |
| 4,235,473 | 11/1980 | Aginar | 297/440 |

*Primary Examiner*—James T. McCall

*Attorney, Agent, or Firm*—Birch, Stewart, Kolasch & Birch

[57] ABSTRACT

An assembled chair made of three components which comprises a right side component portion formed of a plurality of fingers having slots therebetween, the fingers forming a portion of the chair seat and extending within S-shaped configuration into leg portions disposed at the lower end, a left side component portion formed as a mirror image of the right side component portion whereby the fingers of one of the components slidably engages within the slots of the other component forming a completely assembled chair seat, and a back component portion for attachment to the chair seat, the each component portion comprising a back support portion which extends in a first direction substantially vertically from the chair seat and lateral seat support portions which extends in a second direction from the back to the front of the seat where they fixedly engage the upper front portion of the leg members.

6 Claims, 4 Drawing Figures

ASSEMBLED CHAIR OR FLOWERPOT HOLDER

BACKGROUND OF THE INVENTION

The invention relates to an assembled chair or a flower port holder.

Generally it is well known that chairs are a necessity in life. Chairs have been produced in various forms according to the purpose of use, the location of use, and the particular liking of the user. In light of the essential character of the chair, folded chairs have been produced in various forms with an emphasis on practicality. Examples are folding portable type chairs for use outdoor and folding chairs for use indoor.

But these chairs were designed with only one particular use in mind. That is to say, folding chairs are primarily designed only devices for sitting on. As a result, practical uses of these chairs are limited.

Similarly, assembled chairs are also designed to be used for sitting. Further, since these chairs are assembled with tools and often large, these chairs are not portable.

Another disadvantages of folding or assembled chairs is that their components are interconnected to each other and assembled with separate parts by means of tools. Because these chairs have many parts, they are difficult and high cost to manufacture. In general, these chairs have a limited use.

SUMMARY OF THE INVENTION

The present invention can be solved the problems described above. The chair of the present invention not only functions as a chair, but also as a flower pot holder and hanger.

Therefore, an object of the present invention is to provide a multi-functioning assembled chair which can easily be carried because of its small size and can easily be assembled without any tools.

Another object of the present invention is to provide a multi-functioning assembled chair which has an asthenic aspect.

Accordingly, it is possible to hang the flowerpot directly below the seat of the chair of the present invention or to place the flowerpot on the top of the seat depending on the size of the flowerpot.

The present invention relates to an assembled chair or flowerpot holder which comprises two portions which have respectively two legs, two half portions of the seat and a backboard portion. The half-seat portion has respectively a plurality of fingers. The leg portion and half-seat portion are integrally coupled to each other by the molding method etc. or extended as a uniform body. The leg is slightly curved and half-seat portion is extended in horizontal plan by a predeterminded distance, thereby they form "S" shaped configuration. As assembling, the left and right half portions are staggerly coupled with each other by means of their fingers, and then a backboard portion is fixed to the seat of the chair the chair of the present invention is assembled.

DESCRIPTION OF THE DRAWING

These and other objects and advantages of the invention will become clear from the following description with reference to the accompanying drawings wherein.

DETAILED DESCRIPTION OF THE INVENTION

Figure 1:
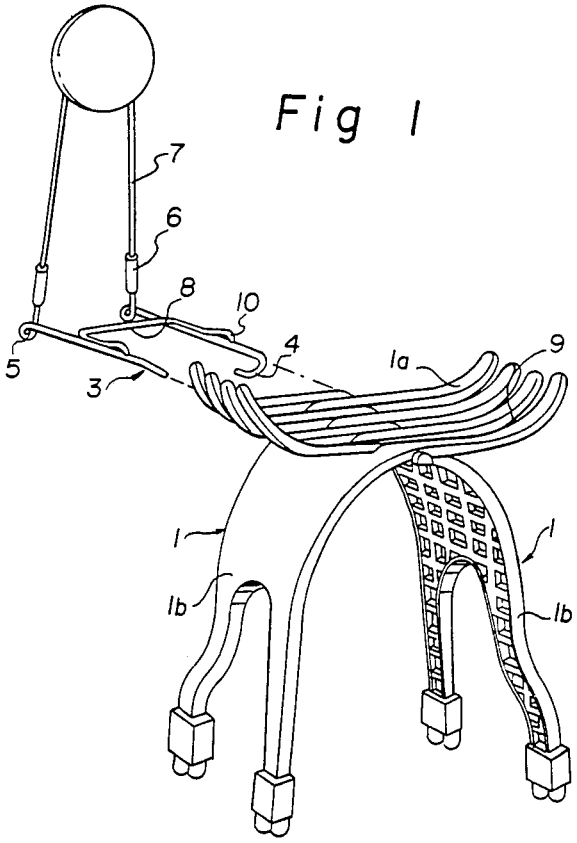
FIG. 1 is a exploded perspective view of the assemble chair or flowerpot holder of the present invention.
Figure 2:
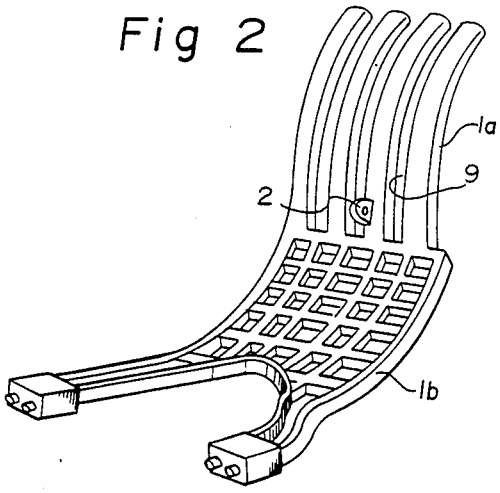
FIG. 2 is a perspective view of one portion according to the invention.
Figure 3:
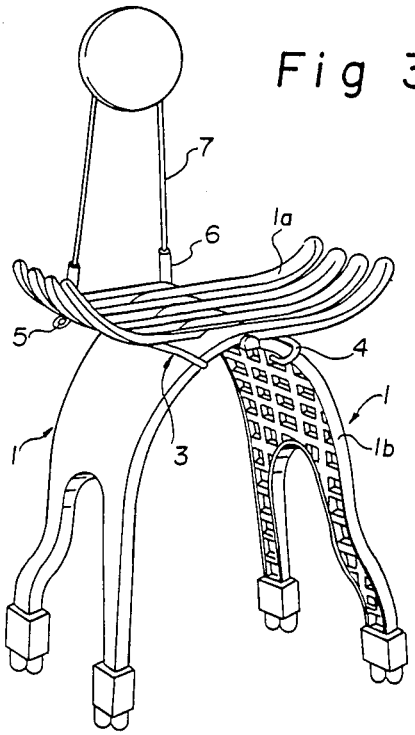
FIG. 3 is a perspective view of the assembled chair or flowerpot holder.
Figure 4:
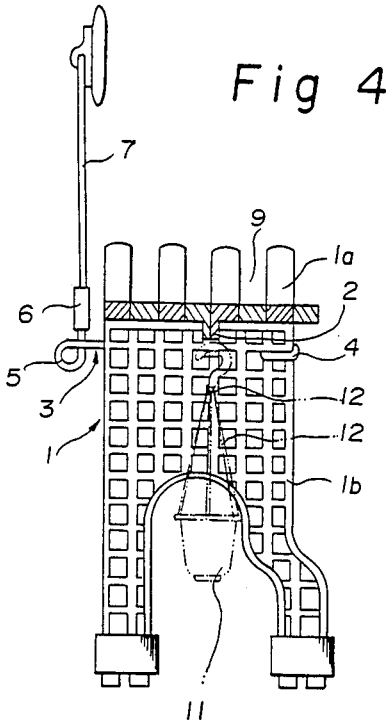
FIG. 4 is a crossectional view of FIG. 3, taken along line A—A.

The assembled chair in accordance with the invention as shown in FIGS. 1 and 3 which comprises two chair portions 1 provided with two leg portions 1*b* and two half-seat portion 1*a* and a backboard portion 3. The leg portion 1*b* and half-seat portions 1*a* are integrally coupled to each other in a manner. The leg portion 1*b* is slightly curved and continues to form half-seat portion 1*a* which is extended in horizontal plan by a predetermined distance, thereby the chair portion 1 forms a "S" shaped configuration as shown in FIG. 2. Also, each respective half-seat portion 1*a* has a plurality of interlocking fingers. Therefore, two chair portions 1 are symmetrically coupled to each other in a manner in which two half portions 1*a* are interlocked with each other at a reference point by means of their fingers. The half-seat portion 1*a* is provided with a flowerpot hanger ring 2 disposed at a predetermined lower portion thereof thereby allowing a flowerpot 11 to hang therefrom (FIG. 4). The backboard portion 3 includes steel wires which are respectively bent into an "L" shaped in order to provide a locking end portion which interlocks to the upper portion of the leg portion 1*b*. That is, the ends of the wires are bent to provide with hooks 4 while the other ends extends tubular connectors 6 and the middle portions thereof are wound one full turn to form spring portions 5. Therefore, the backboard frame 7 containing elastic steel wire ends is assembled by inserting their ends into the short connecting pipes 6 disposed at the ends of the backboard portions 3. Here it is known that backboard portion 3 is constructed to have a backboard.

Thus, the assembled chair in accordance with the present invention is assembled in a manner in which the locking end portions of the backboard portion 3 are passed between the half-seat portions 1*a* and the leg portions 16 and the end hooks 4 of the locking end portions are respectively hooked onto the upper portions of the leg portions 1*b* and firmly locked thereto. The flowerpot hanging rings 2 respectively disposed at each lower portions of half-seat portions 1*a* and when the left and right half-seat portions 1*a* are coupled to each other, the flowerpot hanging rings 2 fit together each other for hanging a flowerpot 11 through a hanger 12' and a loop 12 (FIG. 4). A reinforced member 8 having a "[" shaped configuration is fixed between end locking portions to keep a fixed distance. Preferably both ends of reinforced member 8 have projections 10 for preventing the backboard portions 3 from sliding from the chair portions 1*a* and 1*b*.

As described above, the assembled chair of the present invention has the flowerpot hanging ring 2 to allow flowerpot 11 to hang therefrom while the chair is used for sitting. If it is not used for sitting, the assembled chair can be used simply as a decorative flowerpot holder. As a result, the assembled chair gives the user a comfortable feeling by employing the recoil action of the spring portion 5 when the user leans against backboard 7.

Therefore, it is easy to assemble and disassemble and can be conveniently carried due to its small size. Also as it can be used an attractive flowerpot hanger or flowerpot holder to beautify the environments.

What is claimed is:

1. An assembled chair made of three components which comprises:

a right side component portion formed of a plurality of fingers having slots therebetween, said fingers forming a portion of the chair seat and extending within S-shaped configuration into leg portions disposed at the lower end thereof, a left side component portion formed as a mirror image of the right side component portion whereby the fingers of one of said components slidably engages within the slots of the other component forming a completely assembled chair seat, and a back component portion for attachment to said chair seat, said back component portion comprising a back support portion which extends in a first direction substantially vertically from the chair seat and lateral seat support portions which extends in a second direction from the back to the front of the seat where they fixedly engage the upper front portion of the leg members.

2. The assembled chair of claim 1 wherein a reinforcing member is connected between the lateral seat support portions.

3. The assembled chair of claim 1 wherein one of the fingers is provided with a ring for hanging a flowerpot therefrom.

4. The assembled chair of claim 1 wherein the back support member and the lateral seat support portions form a composite structure having a L-shaped configuration.

5. The assembled chair of claim 3 wherein the lateral seat support portions terminate in hook-like end portions which effect said fixed engagement.

6. The assembled chair of claim 3 wherein the back component is connected to the lateral seat support portions by loop members which produce a spring-type action in the back component portion.

* * * * *